US010557447B2

(12) United States Patent
Ganser

(10) Patent No.: US 10,557,447 B2
(45) Date of Patent: Feb. 11, 2020

(54) FUEL INJECTION VALVE FOR COMBUSTION ENGINES

(71) Applicant: Ganser CRS AG, Winterthur (CH)

(72) Inventor: Marco Ganser, Oberägeri (CH)

(73) Assignee: GANSER HYDROMAG AG, Oberaegeri (CH)

( * ) Notice: Subject to any disclaimer, the term of this patent is extended or adjusted under 35 U.S.C. 154(b) by 0 days.

(21) Appl. No.: 15/507,743

(22) PCT Filed: Aug. 24, 2015

(86) PCT No.: PCT/EP2015/069346
§ 371 (c)(1),
(2) Date: Feb. 28, 2017

(87) PCT Pub. No.: WO2016/041739
PCT Pub. Date: Mar. 24, 2016

(65) Prior Publication Data

US 2017/0298888 A1 Oct. 19, 2017

(30) Foreign Application Priority Data

Sep. 17, 2014 (CH) ..... 1407/14

(51) Int. Cl.
*F02M 63/00* (2006.01)
*F02M 47/02* (2006.01)

(52) U.S. Cl.
CPC ..... *F02M 63/0035* (2013.01); *F02M 47/027* (2013.01); *F02M 63/0005* (2013.01);
(Continued)

(58) Field of Classification Search
CPC ..... F02M 2200/07; F02M 2200/28; F02M 2200/304; F02M 2547/00;
(Continued)

(56) References Cited

U.S. PATENT DOCUMENTS 6,085,719 A * 7/2000 Heinz ..... F02M 45/08 123/300
6,647,966 B2 * 11/2003 Tian ..... F02M 47/027 123/467

(Continued)

FOREIGN PATENT DOCUMENTS

CH 697562 B1 11/2008
CN 102 108 927 A 6/2011

(Continued)

OTHER PUBLICATIONS

International Search Report dated Jan. 28, 2016 in PCT/EP2015/069346.

(Continued)

*Primary Examiner* — Kevin R Steckbauer
(74) *Attorney, Agent, or Firm* — Hershkovitz & Associates, PLLC; Abe Hershkovitz

(57) ABSTRACT

A fuel injection valve (10) comprises an intermediate valve with a mushroom-shaped intermediate valve member (78). The shaft (76) of the intermediate valve member (78) is guided with a sliding fit in the guiding passage (74) of an intermediate component (66). An annular space (120) is defined between the shaft (76) and the head (80) of the intermediate valve member (78) and the intermediate component (66), and a high-pressure inlet (86) opens into the annular space, which is formed by an inner annular space (108) and by a split ring space (118). The split ring space (118) is defined between the head (80) and the intermediate component (66), and is also radially outwardly defined by a sealing bead (112). The adhesion force between the intermediate valve member (78) and the intermediate component (66), which acts against the opening motion of the injection valve member (56), is minimized.

20 Claims, 8 Drawing Sheets

(52) U.S. Cl.
CPC ..... *F02M 63/0029* (2013.01); *F02M 63/0042* (2013.01); *F02M 2200/07* (2013.01); *F02M 2200/40* (2013.01); *F02M 2547/001* (2013.01)

(58) Field of Classification Search
CPC ..... F02M 2547/001; F02M 2547/006; F02M 2547/008; F02M 63/0035; F02M 63/0042
See application file for complete search history.

(56) References Cited

U.S. PATENT DOCUMENTS

| | | | | |
|---|---|---|---|---|
| 7,025,292 | B2 * | 4/2006 | Mohr | F02M 47/027 123/498 |
| 7,225,830 | B1 * | 6/2007 | Kershaw | F16K 17/06 137/512.1 |
| 9,709,011 | B2 * | 7/2017 | Tanada | F02M 63/0026 |
| 9,777,684 | B2 * | 10/2017 | Magel | F02M 63/0029 |
| 10,077,748 | B2 * | 9/2018 | Benson | F02M 55/002 |
| 2003/0056757 | A1 * | 3/2003 | Tian | F02M 47/027 123/446 |
| 2003/0226912 | A1 * | 12/2003 | Mohr | F02M 47/027 239/533.2 |
| 2009/0065614 | A1 * | 3/2009 | Ganser | F02M 47/025 239/584 |
| 2010/0294243 | A1 | 11/2010 | Ganser | |
| 2011/0233309 | A1 | 9/2011 | Yukihiro et al. | |
| 2015/0159607 | A1 * | 6/2015 | Magel | F02M 63/0029 239/533.8 |
| 2016/0010609 | A1 | 1/2016 | Ganser | |

FOREIGN PATENT DOCUMENTS

| | | | |
|---|---|---|---|
| EP | 1 600 627 | A1 | 11/2005 |
| WO | WO 2007/098621 | A1 | 9/2007 |
| WO | WO 2008/046238 | A2 | 4/2008 |
| WO | WO 2010/088781 | A1 | 8/2010 |
| WO | WO 2014/131497 | A1 | 9/2014 |

OTHER PUBLICATIONS

International Preliminary Report on Patentability (IPRP) dated Mar. 21, 2017 in PCT/EP2015/069346.

English language Abstract of DE 10 2006 036843 A1 corresponding to CH 697562 B1.

* cited by examiner

FUEL INJECTION VALVE FOR COMBUSTION ENGINES

FIELD OF THE INVENTION

The invention relates to a fuel injection valve for intermittent injection of fuel into the combustion chamber of an internal combustion engine in accordance with the preamble of claim 1. The invention furthermore relates to a fuel injection valve in accordance with the preamble of claim 16.

BACKGROUND OF THE INVENTION

Fuel injection valves of this kind are known from WO 2007/098621 A1, for example. Fuel injection valves of this kind allow both controllability of the opening movement of the injection valve member and a rapid closing process of the injection valve member with minimum assembly effort. Implementing multiple injections at very short intervals is possible. While the control space and the valve space are connected continuously to one another only via a precise restrictor passage, an intermediate valve otherwise separates these two spaces continuously from one another. A high-pressure feed connected to the high-pressure space of the injection valve and leading into the control space, said feed being of large cross section in comparison with the cross section of the restrictor passage, is controlled by the intermediate valve. Since the cross section of the outlet from the valve space, which outlet is controlled by an electric actuator arrangement, can also be significantly larger than the cross section of the restrictor passage, the opening movement of the injection valve member is dependent substantially exclusively on the cross section of the restrictor passage. When the outlet from the valve space is closed by means of the actuator arrangement, the intermediate valve opens quickly and exposes the large cross-section passage connected to the high-pressure space, bringing about rapid ending of the injection process.

The intermediate valve member of the intermediate valve is of mushroom-shaped design and has a stem, which is guided with a close sliding fit in a guide passage of an intermediate part, and a head, which, in the closed position of the intermediate valve member, rests by means of a sealing surface extending at a radial distance around the stem on an annular intermediate valve seat formed on the intermediate part.

It has been found that, when the high-pressure feed is completely closed and there is therefore surface contact between the sealing surface of the head and the surface of the intermediate valve seat, high adhesion forces may be in effect, possibly making reopening of the intermediate valve to end the injection process more difficult, wherein the accurate timing of the ending of the injection process, in particular, may be impaired.

This adhesion problem is already discussed in document WO 2010/088781 A1. To solve the problem, it is proposed to leave a restricted fluid connection between the high-pressure feed and the sliding fit of the stem on the intermediate part in the closed position of the intermediate valve. For this purpose, the sealing surface of the head and the sealing surface of the intermediate valve seat are designed to slope relative to one another in such a way that, in the closed position of the intermediate valve, they rest sealingly on one another radially on the outside and, radially on the inside, form a restrictor gap which widens in the axial direction for restricting the high-pressure feed in the direction of the valve space. The aim is therefore an annular linear seal between the valve member and the valve seat of the intermediate valve. The extremely precise production of the mushroom-shaped intermediate valve member and of the intermediate part interacting therewith for this solution is extremely delicate and very expensive.

Furthermore, this document discloses embodiments of the fuel injection valve in which the intermediate part and an intermediate element resting on the latter on the side facing away from the guiding part are of circular disk-shaped design and are arranged in a housing section which is almost fully circular-cylindrical on the inside. Between them and the housing, they leave free a section of the high-pressure space. On the one hand, this section is connected to the injection valve seat and, on the other hand, it is connected to the high-pressure fuel inlet. The connection to the high-pressure inlet can be made, for example, by the formation of recesses extending outward in a radial direction and obliquely to the longitudinal axis in the otherwise cylindrical section of the housing. Such recesses weaken the stability of the housing, e.g. of the nozzle body, in this region, requiring a correspondingly thicker design of the housing wall.

Document US 2011/0233309 A1 discloses a fuel injection device in which a pressure surface of a pressure element presses against an opening wall surface in order to interrupt a connection between an inflow port and a pressure control chamber when a connection is established between an outflow port and a return channel by a pressure control valve. The pressure surface of the pressure element is displaced or separated from the opening wall surface in order to open the inflow port in the opening wall surface to the pressure control chamber when the connection between the outflow port and the return channel is interrupted by the pressure control valve. The pressure surface of the pressure element or the opening wall surface of the control housing is provided with a depressed inflow section and a depressed outflow section, which are separated from one another. A depressed dimension of the depressed inflow section is larger than the depressed dimension of the depressed outflow section.

BRIEF SUMMARY OF THE INVENTION

Starting from this prior art, it is an object of the present invention to develop the known fuel injection valve in such a way that, while production is advantageous, adhesion forces between the intermediate valve member and the intermediate part are minimized.

It is furthermore an object of the present invention to develop the fuel injection valve in such a way that a slim construction is made possible. This is achieved by means of an injection valve as claimed in claim 1 and an injection valve as claimed in claim 16.

The fuel injection valve according to the invention for intermittent injection of fuel into the combustion chamber of an internal combustion engine has a housing, which has at least one housing body and one nozzle body with an injection valve seat. Radially on the outside, the housing is preferably of at least approximately circular-cylindrical design over its entire length, optionally with a stepped outside diameter.

In the housing there is a high-pressure space which extends from a high-pressure fuel inlet of the housing to the injection valve seat.

An injection valve member, preferably of needle-shaped design, is arranged so as to be movable in the direction of its longitudinal axis in the high-pressure space in the housing and interacts with the injection valve seat. To inject fuel into the combustion chamber, the injection valve member is raised from the injection valve seat and brought back into contact therewith again to end the injection.

There is also a compression spring, which is supported at one end on the injection valve member and subjects the latter to a closing force directed toward the injection valve seat. The other end of the compression spring is supported in a fixed manner relative to the housing, preferably on a guiding part, which is preferably formed as a guiding sleeve.

The guiding part, in which a control plunger of the injection valve member is guided with a, preferably close, sliding fit, is furthermore arranged in the high-pressure space in the housing.

In the high-pressure space in the housing there is furthermore an intermediate part, preferably of plate-shaped design, which, together with the guiding part and the control plunger, delimits a control space with respect to the high-pressure space and separates it from the latter.

In the fuel injection valve there is furthermore a control device for controlling the axial movement of the injection valve member by varying the pressure in the control space. The control device has an intermediate valve, the mushroom-shaped intermediate valve member of which has a stem, which is guided with a, preferably close, sliding fit in a guide passage of the intermediate part, and a head. The head faces the control space and its sealing surface, which extends at a radial distance around the stem, rests, in the closed position of the intermediate valve member, against an annular intermediate valve seat formed on the intermediate part, thereby forming an annular sealing surface. The annular sealing surface lies in a plane extending at right angles to the axis of the stem and thus of the intermediate valve member.

A high-pressure feed formed on the intermediate part and connected continuously to the high-pressure inlet opens into an annular space, which is delimited by the intermediate part, the stem and the head and has an at least approximately hollow-cylinder-shaped inner annular space extending around the stem.

The intermediate valve cuts off the high-pressure feed and the annular space from the control space in the closed position of the intermediate valve member and, when the intermediate valve member is not in the closed position, it opens the connection from the annular space and the high-pressure feed to the control space.

Furthermore, the intermediate valve continuously cuts off the control space from a valve space by means of the stem, which is guided with a, preferably close, sliding fit on the intermediate part, apart from a restrictor passage of precise size, which is preferably formed on the intermediate valve member and which connects the control space continuously to the valve space.

The fuel injection valve has an electrically actuated actuator arrangement for connecting the valve space to and cutting the valve space off from a low-pressure fuel return.

The annular space furthermore has an annular gap space in the form of a circular ring, which directly adjoins the inner annular space and which is formed by a gap between the intermediate part and the head of the intermediate valve member in the closed position of the intermediate valve member, wherein the gap width of the annular gap space, measured in the longitudinal direction of the intermediate valve member, is smaller than the inner annular space, preferably at least five times smaller.

Since the high-pressure feed opens into the inner annular space, the annular gap space does not form a restricted fluid connection between the high-pressure feed and the sliding fit of the stem of the intermediate valve member on the intermediate part, in contrast to the teaching in document WO 2010/088781 A1.

However, the annular gap space allows a significant reduction in the size of the annular sealing surface and thus in the adhesion forces as well as optimum positioning of the annular sealing surface in the radial direction. Depending on the requirements placed on the fuel injection valve, the annular sealing surface chosen can be further out or further in in the radial direction. Since the intermediate valve member acts as a double-acting plunger, this is a simple way of making the size of the active control plunger surface of the injection valve member adjustable in given space conditions.

The annular gap space preferably has an at least approximately constant gap width, as measured in the closed position of the intermediate valve member and in the longitudinal direction of the stem and thus of the intermediate valve member.

The opening of the high-pressure feed preferably lies fully in the region of the inner annular space. This enables the high-pressure feed to be produced by means of a bore extending in a radial direction. Moreover, it avoids a situation where the opening lies partially in the region of the annular gap space, thus enabling the annular sealing surface to be formed at a shorter distance from the stem, i.e. radially further in.

The annular sealing surface preferably has a width of between 0.1 mm and 1 mm, measured in the radial direction. The width is preferably between 0.2 mm and 0.5 mm. Given a flat annular sealing surface, this ensures good sealing, on the one hand, and minimum adhesion, on the other hand.

The annular gap space preferably has a gap width of 0.04 mm to 0.4 mm, measured in the longitudinal direction of the stem, in the closed position of the intermediate valve member. On the one hand, the annular gap space is of space-saving design and, on the other hand, it is sufficiently large to ensure that the surface of the head between the stem and the sealing surface is provided with an optimum supply of fuel during transient processes. The gap width is preferably at least approximately constant in the region of the entire annular gap space.

The annular gap space preferably has a width of at least 0.2 mm, measured in the radial direction. This allows simple production of the sealing surface on the head, on the one hand, and of the sealing surface of the intermediate valve seat, on the other hand.

A sealing bead in the form of a circular ring is preferably formed on the head, said bead projecting on the side of the head facing the intermediate part and its free end face forming the sealing surface. The end face of the intermediate part which faces the control space is preferably of flat design. It forms the auxiliary valve seat together with the part interacting with the sealing surface of the head.

The sealing flange preferably has an at least approximately square or rectangular cross section. The head preferably has, on its side facing the intermediate part, a circular annular surface which runs around the sealing bead radially on the outside and which lies at least approximately in the same plane as the annular surface between the stem and the sealing bead.

The sealing bead preferably has a cross section corresponding at least approximately to a right trapezoid, wherein the right angles are situated radially on the inside. The shorter of the two mutually parallel sides of the trapezoid thus lies in the sealing surface of the intermediate valve member, and the oblique side extends obliquely, radially outward, away from the intermediate part. The head preferably has, when viewed in cross section, a rectilinear extension of the radially outer oblique side of the trapezoid as far as a radial outer edge. This too allows simple production of the intermediate valve member.

As a further preference, a radially inner undercut can be formed on the side of the head facing the intermediate part, and a radially outer undercut can be formed on the intermediate part, wherein these undercuts delimit the annular sealing surface when the head of the intermediate valve member is resting on the intermediate part.

The reverse construction would also be possible, namely where a radially outer undercut is formed on the head and a radially inner undercut is formed on the intermediate part, wherein these undercuts delimit the annular surface.

A sealing projection in the form of a circular ring, the free end face of which which faces the head forms the valve seat, is preferably formed on the intermediate part, on the side thereof facing the head, the sealing projection preferably being at least approximately square or rectangular in cross section. In this case, the sealing surface on the head can lie in the same plane as the surface between the stem and the sealing surface in the form of a circular ring.

The valve space is preferably continuously connected to the high-pressure space via a further restrictor passage. This further restrictor passage can be formed in the intermediate part, starting from the high-pressure feed, for example. If the valve space is cut off from the low-pressure fuel return by means of the actuator arrangement, a higher pressure is more rapidly built up in the valve space by means of this further restrictor passage, leading to more rapid opening of the intermediate valve member and thus to more rapid ending of the injection process.

An intermediate element, which is preferably of plate-shaped design, preferably rests on the intermediate part, on the side thereof facing away from the guiding part. Formed on said intermediate element, eccentrically with respect to the stem and the guide passage in the intermediate element, is an outlet passage which, together with the intermediate part and the intermediate valve member, delimits the valve space and which, on the side of the intermediate element facing away from the intermediate part can be closed and opened by means of a tappet of the actuator arrangement. Thus, the valve space can be formed with the desired volume in a simple manner. Moreover, that end face of the intermediate element which faces the actuator arrangement and with which the tappet comes into contact to cut off the valve space from the low-pressure fuel return can be of flat design.

The guiding part is preferably formed by a guiding sleeve, which has a circular ring shape in cross section and on which the compression spring is supported. In this case, the compression spring presses the guiding sleeve sealingly against the intermediate part, which is preferably of plate-shaped design.

The fuel injection valve for intermittent injection of fuel into the combustion chamber of an internal combustion engine as claimed in claim 16 likewise has a housing, which has at least one housing body and one nozzle body with an injection valve seat. In the housing there is a high-pressure space, which is connected to a high-pressure fuel inlet and the injection valve seat. Arranged in a movable manner in the housing is a, preferably needle-shaped, injection valve member, which interacts with the injection valve seat. A compression spring, which is supported, on the one hand, on the injection valve member and subjects the latter to a closing force directed toward the injection valve seat, is supported, on the other hand, in a fixed manner relative to the housing. Also present in the housing is an intermediate part, which, together with the guiding part and the control plunger, delimits a control space, and an electrically actuated actuator arrangement for connecting the control space to and cutting the control space off from a low-pressure fuel return for the purpose of controlling the axial movement of the injection valve member by varying the pressure in the control space. The intermediate part is of at least approximately circular-cylindrical design radially on the outside and is arranged in a section of the housing which is at least approximately circular-cylindrical on the inside. It leaves free, between itself and the housing, a section of the high-pressure space.

The outside diameter of the intermediate part corresponds at least approximately to the clear width of the cylindrical section of the housing, and an axially continuous recess, which forms that section of the high-pressure space which is delimited by the intermediate part and the housing, is formed on the intermediate part.

Thus, the housing is not weakened in the relevant section by recesses for carrying fuel from the high-pressure fuel inlet to the injection valve seat. The recess for carrying the fuel is situated exclusively on the intermediate part, which is not exposed to particularly high pressure loads.

The guiding element is preferably formed by a guiding sleeve which has a cross section in the form of a circular ring and on which the compression spring is supported and, at the same time, presses the guiding sleeve sealingly against the intermediate part, which is preferably of plate-type design.

The control device preferably has an intermediate valve, the intermediate valve member of which opens a high-pressure feed into the control space in its open position and, in the closed position, interrupts the high-pressure feed and continuously cuts the control space off from a valve space, wherein the control space and the valve space are connected continuously to one another via a restrictor passage, which is preferably formed on the intermediate valve member. In this embodiment, the electrically actuated actuator arrangement is intended to connect the valve space to the low-pressure fuel return in its open position and to cut the valve space off from the low-pressure fuel return in its closed position.

Furthermore, the fuel injection valve just described is preferably designed in the manner defined in claims 1 to 15.

The cross section of the recess on the intermediate part preferably has the shape of a circular sector. This recess is particularly simple to produce.

An at least approximately circular-cylindrical intermediate element, likewise arranged in the section of the housing and preferably of plate-shaped design, preferably rests on the intermediate part on the side facing away from the guiding part. The outside diameter of the intermediate element corresponds at least approximately to the clear width of the circular-cylindrical section of the housing, and an axially continuous recess, which is in alignment with the recess on the intermediate part, is likewise formed on the intermediate element. It continues that section of the high-pressure space which is delimited by the intermediate part and the housing, preferably with the same cross section. For this purpose, it preferably likewise has the cross section of the circular sector.

BRIEF DESCRIPTION OF THE DRAWINGS

The invention is described in greater detail by means of the embodiments illustrated in the figures, which are purely schematic and of which.

In the description of the figures, the same reference signs are used in all cases for corresponding parts.

DETAILED DESCRIPTION OF THE INVENTION

Figure 1:
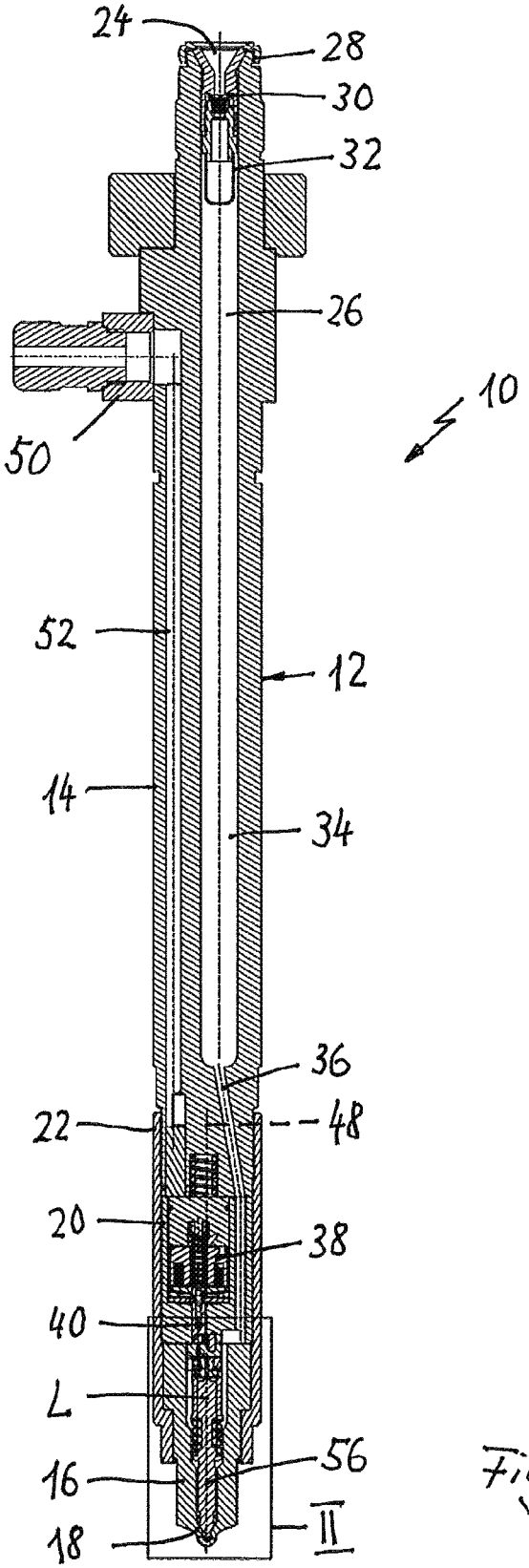
FIG. 1 shows an injection valve according to the invention in longitudinal section.

The fuel injection valve 10 shown in FIG. 1 is intended for intermittent injection of fuel into the combustion chamber of an internal combustion engine. Here, the fuel is under a very high pressure of, for example, up to 2000 bar or more.

The fuel injection valve has a housing 12 with a housing body 14, a nozzle body 16, on which an injection valve seat 18 is formed, and an actuator-receiving body 20, which is arranged between the housing body 14 and the nozzle body 16. A union nut 22 supported on the nozzle body 16 receives the actuator-receiving body 20 and is screwed onto the housing body 14. The end faces of the housing body 14 and the actuator-receiving body 20, as well as of the latter and the nozzle body 16, rest against one another, and said bodies are pressed sealingly against one another by means of the union nut 22 and aligned with one another in the direction of the housing axis L.

The external shape of the housing 12 is at least approximately circular-cylindrical in a known manner.

Arranged on the end of the housing body 14 facing away from the nozzle body 16 is a high-pressure fuel inlet 24, from which a high-pressure space 26 extends within the interior of the housing 12 as far as the injection valve seat 18. The high-pressure fuel inlet 24 is formed by a valve support 28, which supports a check valve 30 and a basket-like perforated filter 32 for retaining any foreign bodies in the fuel. The disk-shaped valve member of the check valve 30, which interacts with a valve seat formed on the valve support 28, has a bypass bore.

In a known manner, the check valve 30 allows fuel fed in via a high-pressure feed line to flow virtually without hindrance into the high-pressure space 26, but prevents fuel from flowing out of the high-pressure space 26 into the high-pressure feed line, except through the bypass.

The construction and operation of the modular unit, which is designed as a cartridge, comprising the valve support 28, the check valve 30 and the perforated filter 32, are disclosed in detail in the earlier application PCT/EP2014/000447. The high-pressure fuel inlet 24 and the valve support 28 with check valve 30 and perforated filter 32 can also be designed as disclosed in publication WO 2013/117311 A1. One possible embodiment of the high-pressure fuel inlet 24 and of the check valve 30 as well as of a filter cartridge instead of the perforated filter 32 is known from WO 2009/033304 A1.

The disclosure of the abovementioned application and publications is incorporated by reference into the present disclosure.

Adjoining the valve support 28, the high-pressure space 26 has a discrete storage chamber 34, which is formed on the housing body 14 and, on the other hand, is connected to the injection valve seat 18 by a flow channel 36 of the high-pressure space 26.

The dimensioning and operation of the discrete storage chamber 34 together with the check valve 30 and bypass are disclosed in detail in publication WO 2007/009279 A1; this disclosure is also incorporated by reference into the present disclosure.

Accommodated in a recess in the actuator-receiving body 20 in a known manner is an electrically actuated actuator arrangement 38, which is intended, by means of its tappet 40, which is spring-loaded in one direction and can be moved in the other direction by means of an electromagnet of the actuator arrangement 38, to close a low-pressure outlet 42 in order to cut off a valve space 44 from a low-pressure fuel return 46 (see FIGS. 2 and 3) and to open the low-pressure outlet 42 in order to connect the valve space 44 and the low-pressure fuel return 46 to one another. The longitudinal axis of the tappet 40 and thus of the actuator arrangement 38, said axis being denoted by 48, is parallel to and eccentric with respect to the longitudinal axis L.

A channel 52, in which the electric control line for controlling the actuator arrangement 38 is accommodated, extends from an electric terminal 50, through the housing body 14, to the actuator arrangement 38, said channel extending parallel to the discrete storage chamber 34 arranged eccentrically with respect to the longitudinal axis L of the housing 12 and thus of the fuel injection valve 10.

Figure 2:
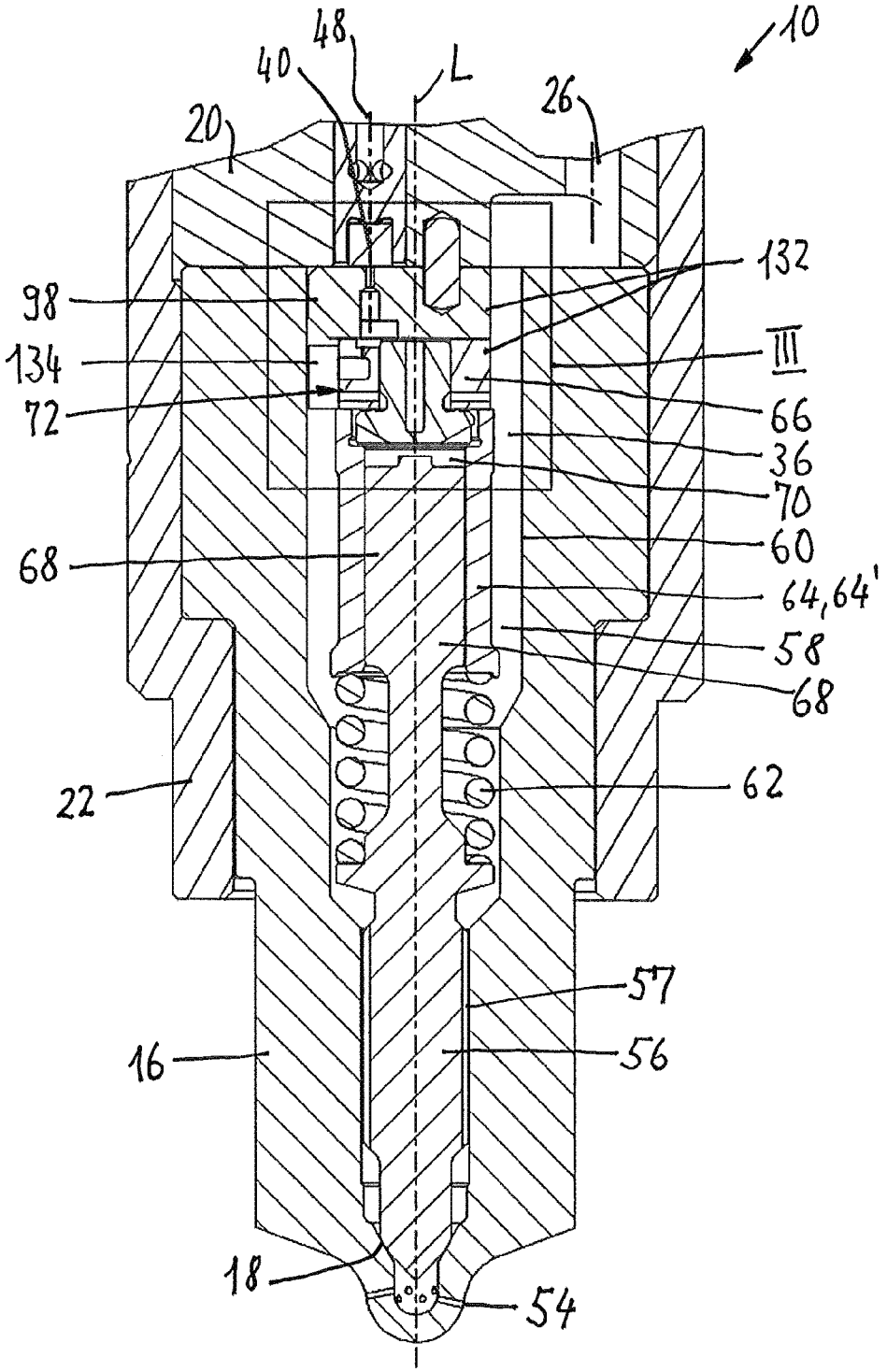
FIG. 2 shows that part of the injection valve which is indicated by a rectangle denoted II in FIG. 1, on an enlarged scale as compared with FIG. 1.

As is apparent from FIG. 2, which is enlarged relative to FIG. 1, the conical injection valve seat 18 is formed on the nozzle body 16, said seat being connected directly to the storage chamber 34 and thus to the high-pressure fuel inlet 24 by the flow channel 36.

Downstream of the injection valve seat 18, as viewed in the flow direction of the fuel, injection openings 54 are formed in a hemispherical free end region of the nozzle body 16 in a known manner, through which openings the fuel, which is under very high pressure, is injected into the combustion chamber of the combustion engine when the injection valve member 56 is raised from the injection valve seat 18.

The injection valve member 56 is of needle-shaped design and interacts with the injection valve seat 18. The injection valve member 56 is guided in such a way as to be movable in the direction of the longitudinal axis L in a guide bore 57 in the nozzle body, said guide bore being concentric with respect to the longitudinal axis L and belonging to the high-pressure space 26, wherein low-loss flow of fuel to the injection valve seat 18 and to the injection openings 54 is made possible by recesses on the injection valve member 56, which extend in the longitudinal direction and are outwardly open in a radial direction.

Upstream of this guide bore 57, as can be seen especially from FIG. 2, the interior space 58 of the nozzle body 16, which belongs to the high-pressure space 26, is designed to widen twice toward the actuator-receiving body 20, wherein that section of the interior space 58 which extends approximately in the longitudinal center of the nozzle body 16, as far as the end thereof which faces the actuator-receiving body 20, defines an internally circular-cylindrical section 60 of the nozzle body 16 with a constant cross section and thus of the housing 12.

Formed on the injection valve member 56, between this section 60 and the guide bore 57, is a support ring, on which one end of a compression spring 62 is supported. The other end of the compression spring 62 is supported on the end of a guiding sleeve 64', which forms a guiding part 64. The compression spring 62 subjects the injection valve member 56 to a closing force that acts in the direction of the injection valve seat 18. On the other hand, the compression spring 62 holds that end of the guiding part 64 or guiding sleeve 64' which faces away from the compression spring 62 in sealing contact with an intermediate part 66 of disk-shaped design.

A control plunger 68 formed on the injection valve member 56 is guided so as to be movable in the direction of the longitudinal axis L in the guiding sleeve 64', with a close sliding fit of about 3 μm to 5 μm. The control plunger 68, the guiding sleeve 64' and the intermediate part 66 delimit a control space 70 with respect to the high-pressure space 26.

The intermediate part 66 is part of a control device 72, which is also described with reference to FIG. 3.

Figure 3:
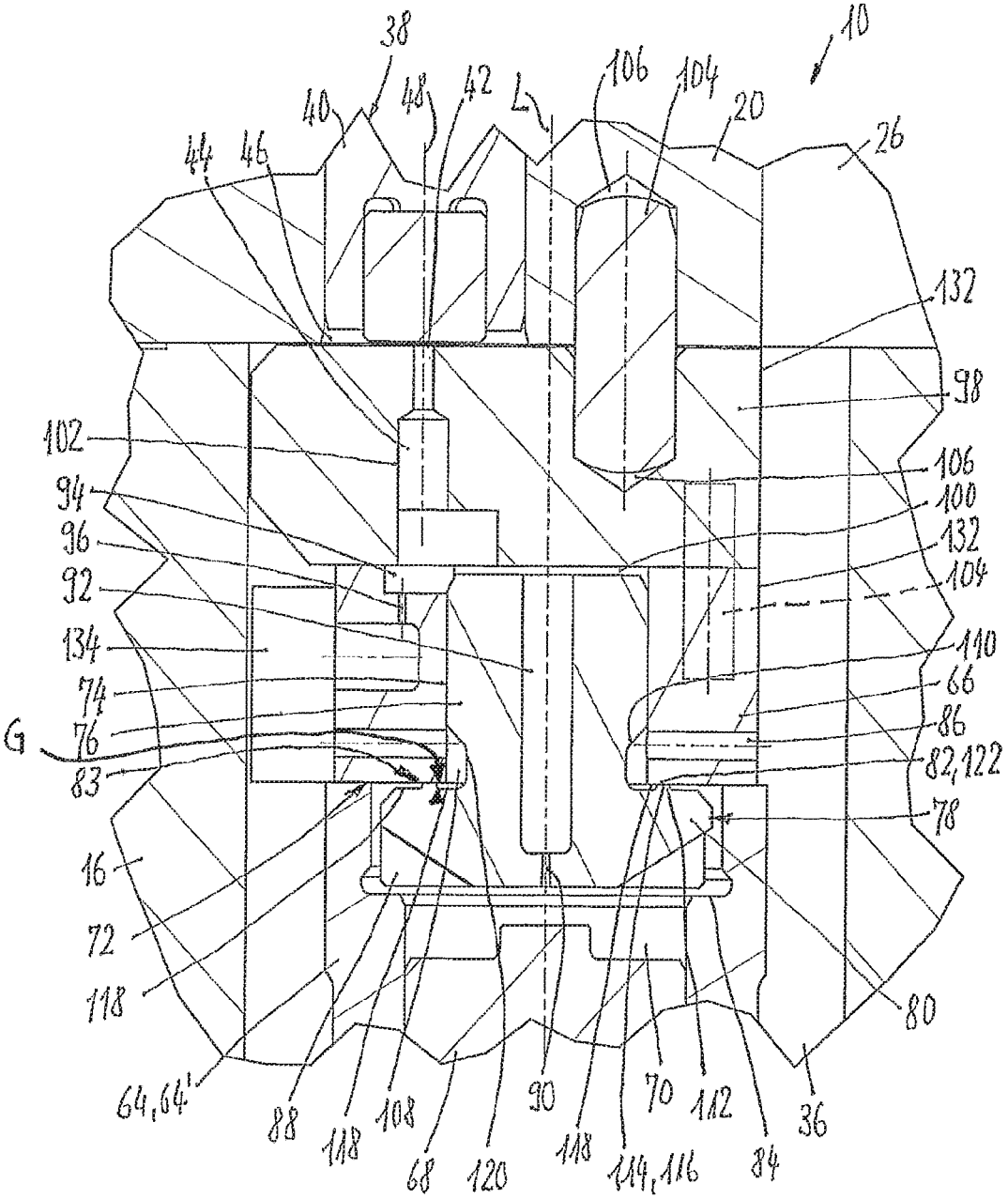
FIG. 3 shows that part of the fuel injection valve which is framed by the rectangle denoted III in FIG. 2, together with the control device, on an enlarged scale as compared with FIG. 2.

As shown particularly by FIG. 3, a circular-cylindrical guide passage 74 extends through the intermediate part 66 from the flat end face facing the control space 70 to the likewise flat end face facing away from the control space 70. A stem 76 of an intermediate valve member 78 of mushroom-shaped design is guided in said passage with a close sliding fit of about 3 μm to 10 μm. A head 80 of the intermediate valve member 78, said head being integral with the stem 76, is situated in the control space 70 and, by means of its side facing the intermediate part 66, interacts with the intermediate part 66, the flat end face of which forms an annular intermediate valve seat 82.

Together with the intermediate valve seat 82 formed on the intermediate part 66, the intermediate valve member 78 forms an intermediate valve.

A stop shoulder 84, which limits the opening stroke of the intermediate valve member 78, is formed on the guiding sleeve 64' at a distance from the intermediate part 66. In order to allow flow of the fuel from a fuel feed 86 into the control space 70 with as little loss as possible, there is a sufficiently large gap radially on the outside between the head 80 and the guiding sleeve 64', and the head 80 has, on its side facing the stop shoulder 84, four wedge-like flow grooves 88, see also FIG. 5, which allow the fuel to flow from the gap to the control plunger 68 with little loss, even when the intermediate valve member 78 is in the open position and the head 80 is resting on the stop shoulder 84.

A restrictor passage 90 is formed on the intermediate valve member 78, adjoining the control space 70, said passage opening at the other end into a blind hole 92 formed in the intermediate valve member 78 concentrically with the longitudinal axis L.

Figure 6:
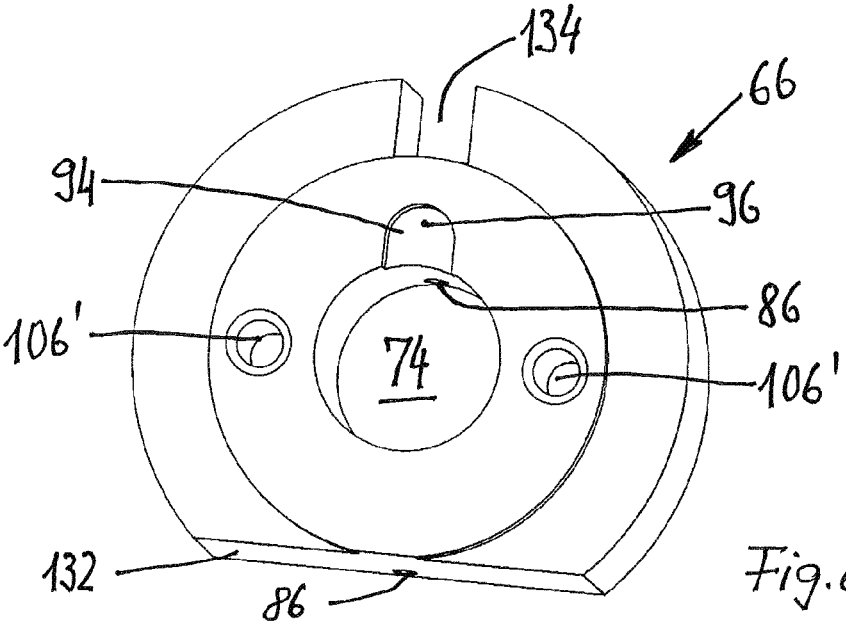
FIG. 6 shows an intermediate part for the intermediate valve member of mushroom-shaped design shown in FIG. 5, in perspective.

In the illustrative embodiment shown in FIGS. 1 to 3, the fuel feed 86 is formed by two diametrically opposite bores which pass in a radial direction through the intermediate part 66 and open into the guide passage 74. The intermediate part 66 is also shown in FIG. 6. The fuel feed 86 is continuously connected to the high-pressure fuel inlet 24 and has a flow cross section many times greater than the restrictor passage 90.

On the end face facing away from the control space 70, the intermediate part 66 has a depression 94, which is U-shaped when seen in plan view, which opens, on the one hand, into the guide passage 74 and, on the other hand, is continuously fluidically connected to the high-pressure space 26 and thus to the high-pressure fuel inlet 24 via a further restrictor passage 96 formed in the intermediate part 66.

Figure 7:
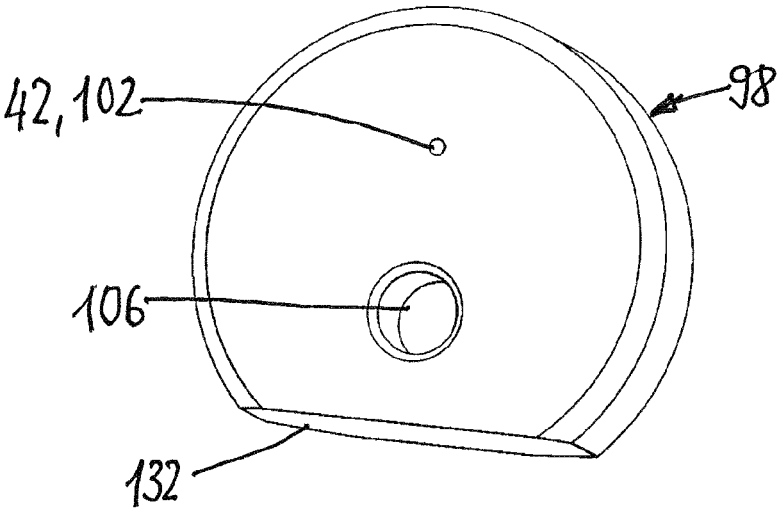
FIG. 7 shows an intermediate element, which is intended to rest sealingly on the intermediate part, likewise in perspective.

Resting flat and sealingly on that side of the intermediate part 66 which faces away from the guiding sleeve 64' is an intermediate element 98, which is likewise of disk-shaped design and which is also shown in FIG. 7. In the region of the guide passage 74 there is always a flow gap 100 between the intermediate element 98 and the end of the stem 76 of the intermediate valve member 78, even if this is in the closed position.

Extending through the intermediate element 98, concentrically with respect to the longitudinal axis 48, there is an outlet bore 102 tapering in a step-like manner, which opens into the flow gap 100 and the depression 94, on the one hand, and forms the low-pressure outlet 42, on the other hand.

For the sake of completeness, it may be mentioned that the flow cross section of this outlet bore 102 is significantly larger at all points than the sum of the cross section of the restrictor passage 90 and of the further restrictor passage 96.

The intermediate element 98 is likewise arranged in the section 60 of the nozzle body 16 and it rests sealingly by means of its flat end face facing away from the intermediate part 66 on the corresponding end face of the actuator-receiving body 20.

For correct positioning of the intermediate element 98 relative to the actuator-receiving body 20 and thus relative to the actuator arrangement 38, both the intermediate element 98 and the actuator-receiving body 20 have mutually aligned, mutually facing positioning bores 106 in the form of blind holes, into which a common positioning pin 104 is inserted.

In order to fix the position of the intermediate part 66 relative to the intermediate element 98, two mutually facing further positioning bores 106' in the form of blind holes that are aligned in pairs with one another, into which bores positioning pins 104 are likewise inserted, are formed on each of these components, wherein these positioning bores 106' lie eccentrically with respect to the longitudinal axis L in a common plane which extends at right angles to the section plane shown in FIG. 3, for which reason the positioning pin 104 is shown in dashed lines in this figure.

Figure 4:
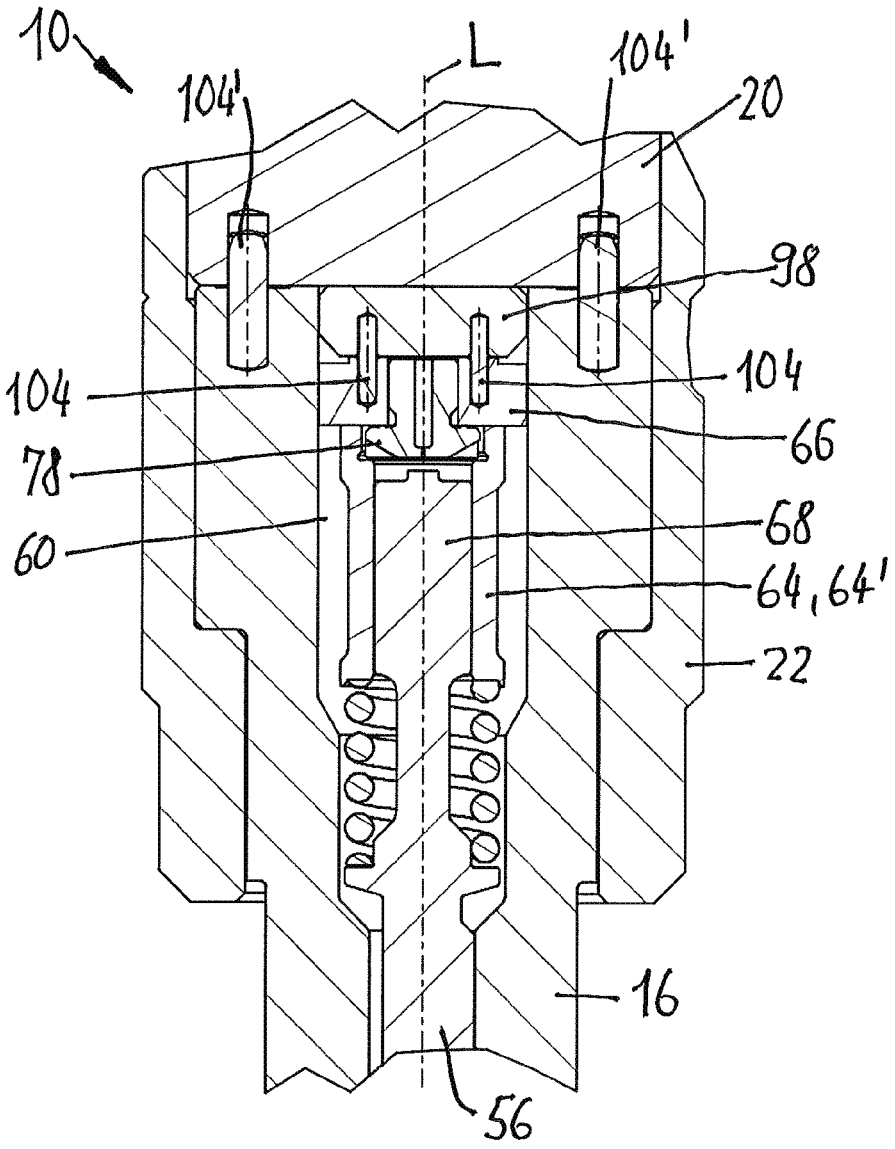
FIG. 4 shows that part of the fuel injection valve which is indicated by the rectangle II in FIG. 1, in a longitudinal section extending at right angles to the section plane in FIG. 1, on an enlarged scale as compared with FIG. 1.

FIG. 4 shows the longitudinal section in this plane, wherein the two positioning pins 104 are now shown in solid lines. Further positioning pins 104', which are inserted into corresponding positioning bores in the nozzle body 16 and in the actuator-receiving body 20, define the position of these two bodies relative to one another.

The intermediate part 66, together with the stem 76 and head 80 of the intermediate valve member 78, delimits an approximately hollow-cylindrical inner annular space 108, which extends around the stem 76 and into which the high-pressure feed 86 continuously opens.

To this extent, as described up to now, the fuel injection valve 10 is of identical design in all embodiments of the control device 72. Here, the intermediate valve 83 has the task of cutting off the high-pressure feed 86 and the inner annular space 108 from the control space 70 in the closed position of the intermediate valve member 78 and, when the head 80 is raised from the intermediate valve seat 82 formed on the intermediate part 66, of opening the connection from the inner annular space 108 and the high-pressure feed 86 to the control space 70.

Figure 5:
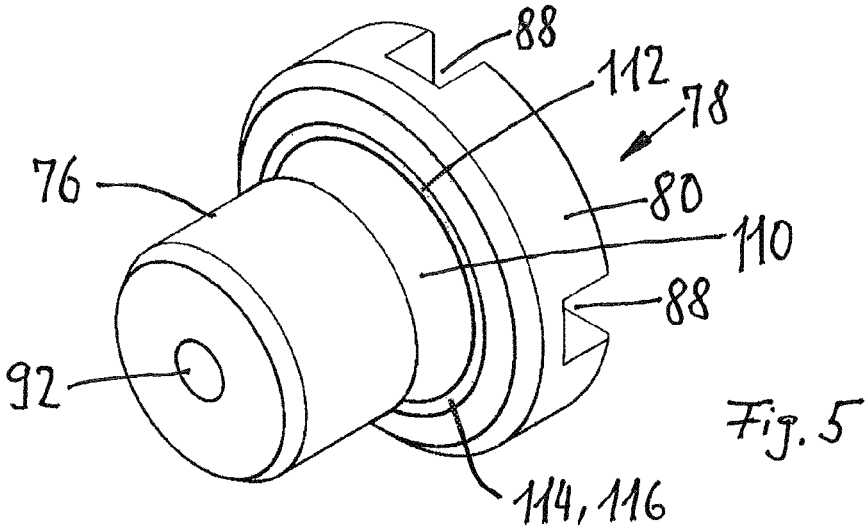
FIG. 5 shows a mushroom-shaped intermediate valve member in perspective.

As is apparent especially from FIGS. 3 and 5, the stem 76 of the intermediate valve member 78 has an encircling annular groove 110, which is open to the outside in a radial direction and which directly adjoins the head 80. When viewed in the direction of the longitudinal axis L, the annular groove 110 has a dimension such that the opening of the high-pressure feed 86 always lies completely in the region of the annular groove 110, even when the intermediate valve member 78 is in the open position and is resting on the stop shoulder 84.

In the illustrative embodiment shown, the annular groove 110 has a trapezoidal cross section, wherein the oblique side is remote from the head 80 and serves to deflect the fuel flowing through the two bores of the high-pressure feed 86 with little loss when the intermediate valve member 78 is open.

On the side facing the stem 76 and thus the intermediate part 66, a sealing bead 112 in the form of a circular ring is formed on the head 80, projecting relative to the remaining region of this side of the head 80, the free end face 114 of said sealing bead forming the sealing surface 116 of the intermediate valve member 78. Opposite this sealing surface 116, the head 80 has an undercut 118 radially on the inside and radially on the outside on the side facing the intermediate part 66, wherein the surfaces of these undercuts 118 are situated in a plane which extends at right angles to the longitudinal axis L in the illustrative embodiment shown. It goes without saying that the sealing surface 116 likewise lies in a plane which extends at right angles to the longitudinal axis L, and the flat end face of the intermediate part 66, which forms the intermediate valve seat 82, likewise lies in a plane which extends at right angles to the longitudinal axis L.

The guide passage 74 extends in the form of a circular cylinder with the same cross section through the entire intermediate part 66. Since the sealing bead 112 is offset outward in a radial direction by about 0.2 mm to 1.0 mm relative to the guide passage 74, there remains an annular gap space 118 between the head 80 and the intermediate part 66 in the closed position of the intermediate valve member 78, said annular gap space having a Gap with G and being delimited radially on the outside by the sealing bead 112 and forming, radially on the inside, together with the inner annular space 108, an annular space 120, which is delimited by the intermediate valve member 78 and by the intermediate part 66.

In the illustrative embodiment shown, the width of the annular sealing surface 122, measured in the radial direction, is between 0.1 mm and 1.0 mm. In the illustrative embodiment shown, the annular gap space 118 furthermore has a width, measured in the radial direction, of about 0.5 mm.

From FIGS. 3 and 5, it can be seen that the sealing bead 112 can also be provided further out in the radial direction. This allows optimum matching of the intermediate valve 83 to the desired injection characteristics. If the active area of the intermediate valve member 78 designed as a double-acting plunger is enlarged, the intermediate valve 83 opens more quickly to end an injection process than if this active area is chosen to be smaller.

Furthermore, the adhesion between the intermediate part 66 and the intermediate valve member 78 is minimized in that the annular sealing surface 112 formed by the sealing surface 116 and the intermediate valve seat 82 is minimized.

The further restrictor passage 96 also promotes the movement of the intermediate valve member 78, but it is also possible to dispense with this, depending on the specific requirements.

If the intermediate valve 83 is closed and if the tappet 40 is raised from the low-pressure outlet 42 for an injection, the opening movement of the injection valve member 56 is determined almost exclusively by the restrictor passage 90.

For the sake of completeness, it should be mentioned that the valve space 44 is formed by the blind hole 92, the flow gap 100, the depression 94 and outlet bore 102.

Figure 8:
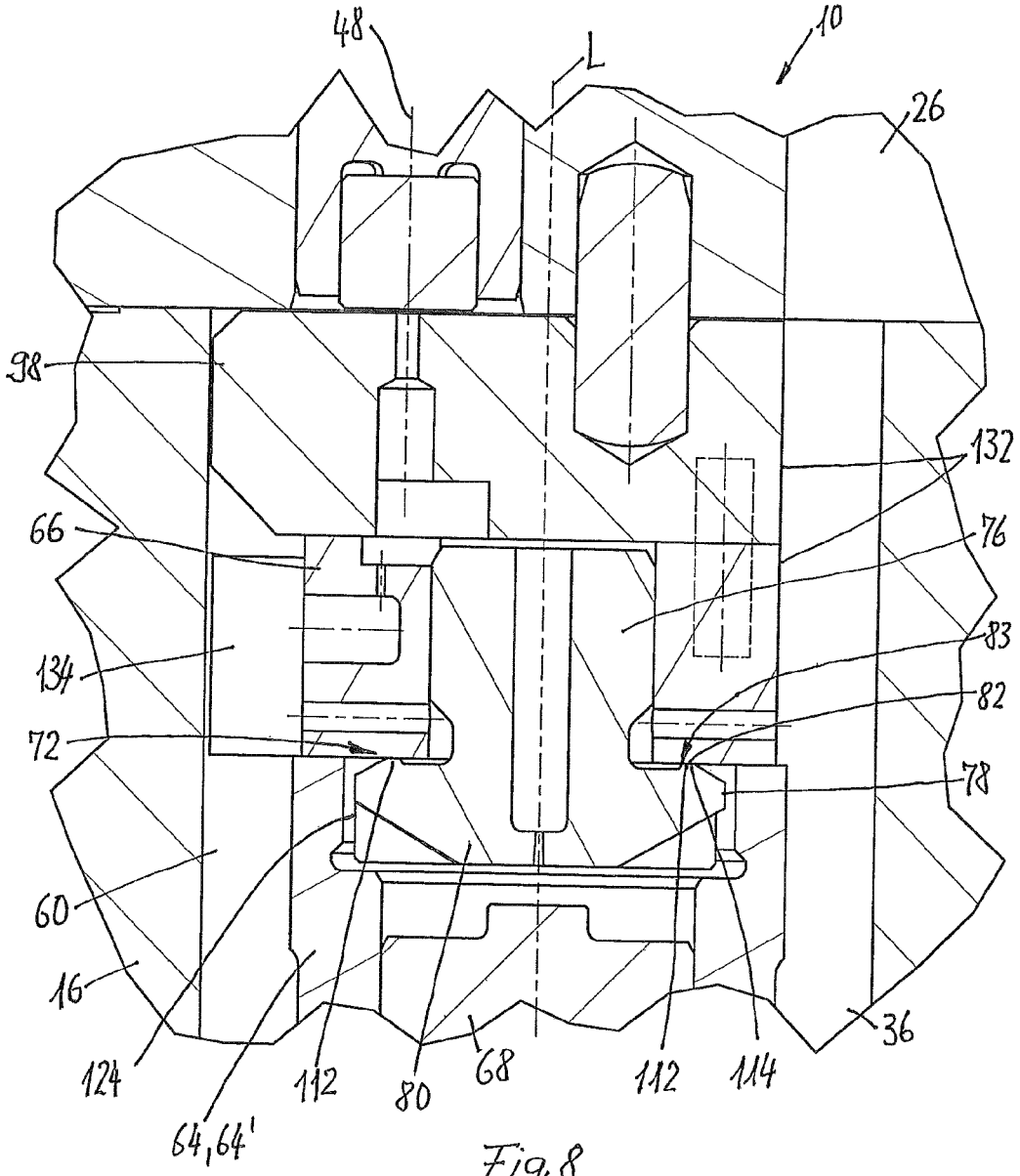
FIG. 8 shows a second embodiment of the control device, illustrated in the same way as in FIG. 3.

In the embodiment shown in FIG. 8, only the cross section of the sealing bead 112, which is of approximately rectangular design in FIG. 3, is now trapezoidal, wherein the right angle is radially on the inside and the oblique side is radially on the outside. The oblique side has an extension as far as the radial outer edge 124 on the head 80, said extension being rectilinear when viewed in cross section.

This variant is appropriate especially when the sealing bead 112 is situated far out on the head 80 in the radial direction. In this embodiment too, the width of the annular sealing surface 122 and thus of the free end face 114 of the sealing bead 112 is 0.1 mm to 1 mm, preferably 0.2 mm-0.5 mm.

Figure 9:
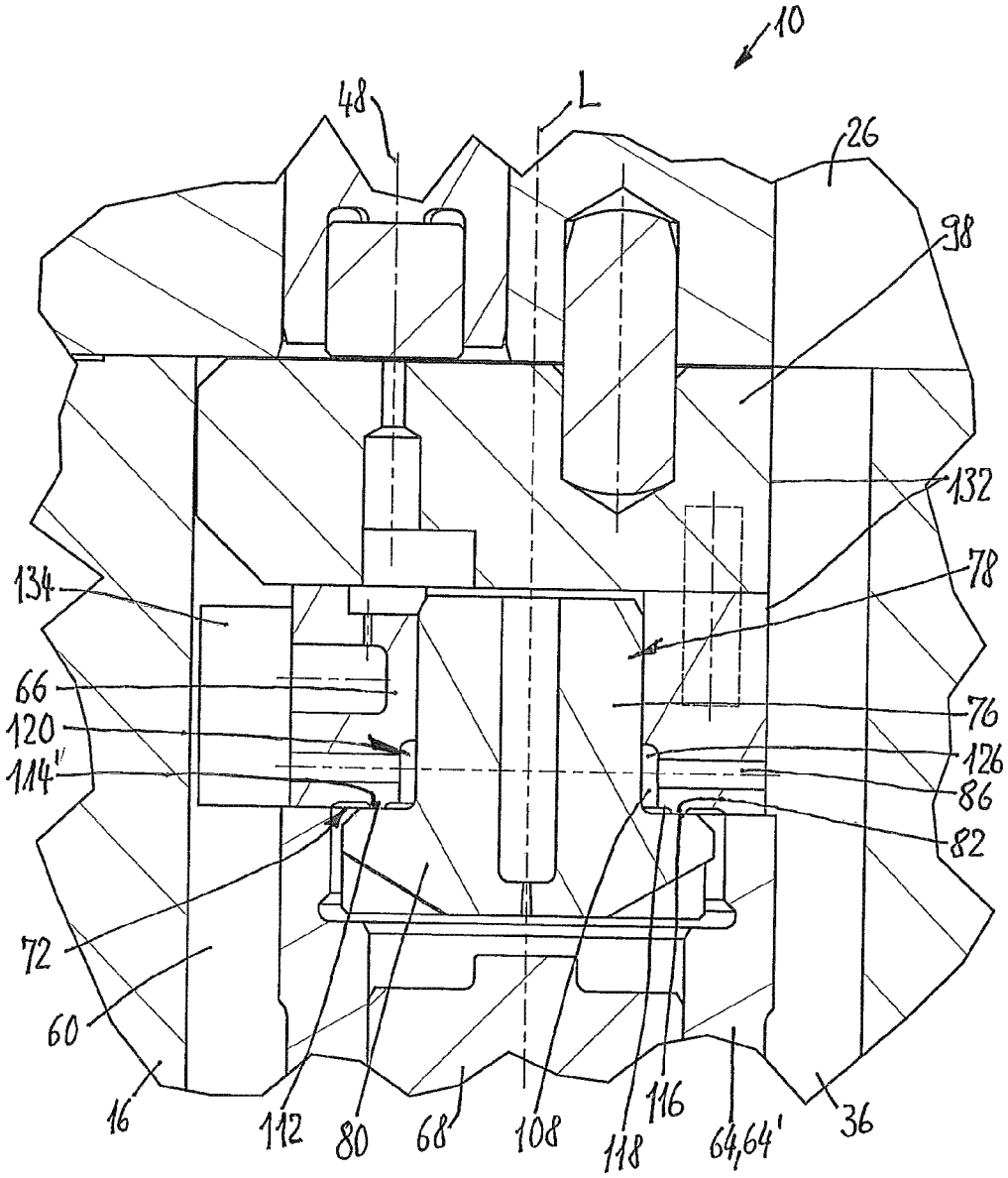
FIG. 9 shows a third embodiment of the control device, illustrated in the same way as in FIGS. 3 and 8.

In the embodiment shown in FIG. 9, the stem 76 of the intermediate valve member 78 has a circular-cylindrical shape with a constant diameter as far as the head 80, wherein, to avoid high stresses, the transition from the stem 76 to the head 80 is, of course, rounded. A cylindrical annular recess 126 is formed in the intermediate part 66, from the end face thereof facing the head 80, which annular recess 126 extends as far as the opposite end of the opening of the high-pressure feed 86. This end of the annular recess 126 is of rounded design.

In relation to this cylindrical annular recess 126, the intermediate valve seat 82 is offset outward in a radial direction in accordance with the embodiments shown in FIGS. 3 and 8. In contrast to this, however, the sealing bead 112 in the form of a circular ring is formed on the intermediate part 66 in the embodiment shown in FIG. 9. It has an approximately rectangular cross-sectional shape and its end face 114' facing the head 80 forms the annular intermediate valve seat 82.

As shown in FIG. 9, the sealing bead 112 can be formed by undercuts on the intermediate part 66, which are situated radially on the inside and radially on the outside relative to said bead.

That side of the head 80 which faces the intermediate part 66 can be designed as a flat annular surface, of which an annular section forms the sealing surface 116, which interacts with the intermediate valve seat 82.

The annular gap space 118 of the annular space 120, which also has the inner annular space 108, is formed by the undercut situated radially on the inside.

Figure 10:
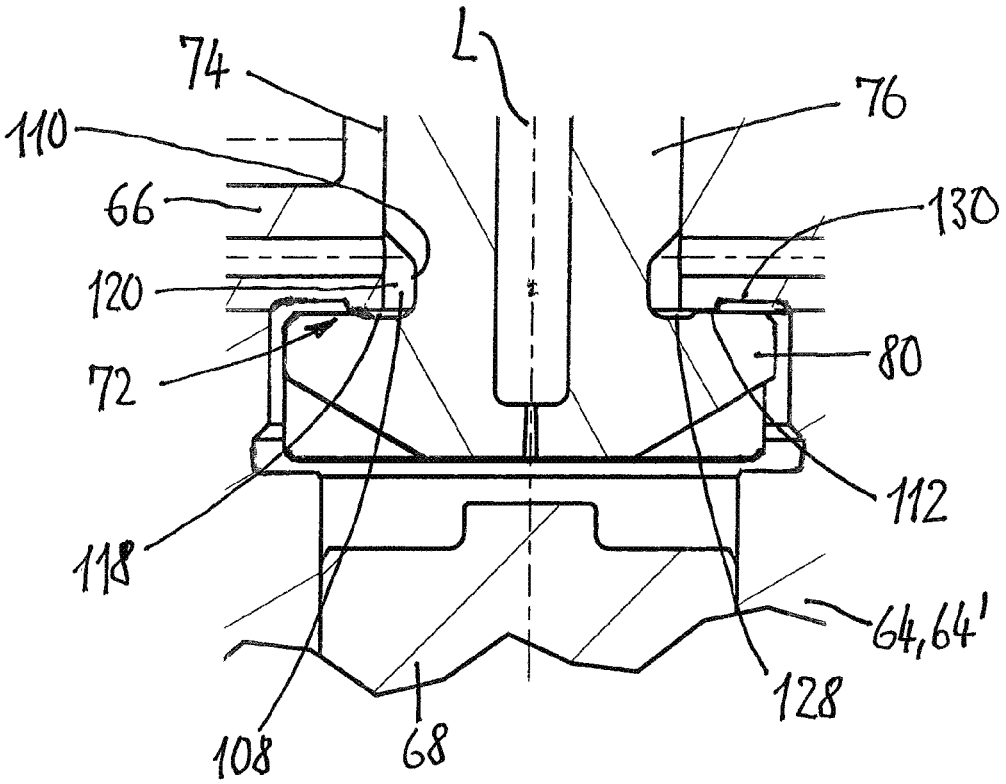
FIG. 10 shows a detail of a fourth embodiment of the control device, illustrated in the same way as in FIGS. 3, 8 and 9.

In the embodiment shown in FIG. 10, an undercut 128 is formed on the head 80, radially on the inside relative to the flat side otherwise facing the intermediate part 66.

As in the embodiment shown in FIGS. 3 and 8, the guide passage 74 extends with a constant cross section through the intermediate part 66. The end face thereof facing the head 80 has a further undercut 130, although this is situated radially on the outside relative to undercut 128. The annular sealing surface 120 is thus delimited radially on the inside by undercut 128 and radially on the outside by the further undercut 130. When viewed in the radial direction, the distance between the two undercuts 128 and 130 is between 0.1 mm and 1 mm, preferably 0.2 mm and 0.5 mm.

Here too, the annular space 120 is formed by the annular gap space 118 and the inner annular space 108 formed by the annular groove 110 on the stem 76; in this regard, see also FIG. 3.

In this embodiment too, it is possible to make the stem 76 cylindrical over its entire length and to provide an annular recess 126 on the intermediate part 66.

As is apparent especially from FIGS. 2 to 4 and 8 and 9, the intermediate part 66 and the intermediate element 98 are arranged in the internally circular-cylindrical section 60, which is formed on the nozzle body 16 in the illustrative embodiment shown. As is also apparent from FIGS. 6 and 7, these are of disk-shaped design and are in the form of circular rings radially on the outside, with the exception of a recess 132 in the form of a circular sector, when seen in plan view. The outside diameter of the part in the form of a circular cylinder corresponds substantially to the clear width of section 60.

In the assembled state, the intermediate part 66 and the intermediate element 98 are inserted into the section 60, wherein the recesses 132 on the intermediate part 66 and the intermediate element 98 are in alignment with one another and the flat sides of the intermediate part 66 and the intermediate element 98, which are formed by the recesses 132 in the form of circular sectors, together with the inner wall of the housing 12 in the section 60 delimit a section of the high-pressure space 26 and of the flow channel 36. This section allows fuel to flow with little loss from the high-pressure fuel inlet 24 to the injection valve seat 18, wherein the relevant part of the housing 12 does not have to be weakened and its wall can have the same wall thickness all the way round.

In FIG. 6, the guide passage 74, the two bores of the high-pressure feed 86, which extend radially with respect to said passage, the depression 94 with the further restrictor passage 96, and the two positioning bores 106' are shown on the intermediate part 66. It is furthermore apparent that the intermediate part 66 has an axially continuous groove-shaped inflow recess 134 on the side diametrically opposite the recess 132 in the form of a circular sector, said inflow recess being open toward the outside in a radial direction, into which recess the associated bore of the high-pressure feed 86 opens. This inflow recess 134 allows fuel to flow through this bore into the guide passage 74 and thus into the annular space 120.

In addition to the low-pressure outlet 42, FIG. 7 also shows the positioning bore 106 and the circular recess 132.

Starting from the closed position of the intermediate valve 83, shown in the figures, the tappet 40 is raised from the intermediate element 98 by means of the electromagnet of the actuator arrangement 38 for an injection, thereby opening the low-pressure outlet 42. This has the effect that a larger quantity of fuel flows out of the valve space 44 into the low-pressure fuel return 46 per unit time than can flow in behind into the valve space 44 through the restrictor passage 90 and any further restrictor passage 96 that may be present. As a result, the pressure in the valve space 44 falls, with the result that, on the one hand, the intermediate valve member 78 is pressed against the intermediate part 66 with a large force in order to keep the intermediate valve 83 reliably closed and, on the other hand, the pressure in the control space 70 falls. This, in turn, has the effect that the injection valve member 56 is raised from the injection valve seat 18 counter to the force of the compression spring 62 by the action of the double-acting control plunger 68, thereby starting an injection of fuel into the combustion chamber of the combustion engine.

If this injection is to be ended, the tappet 40 is brought into contact with the intermediate element 98, thereby closing the low-pressure outlet 42. The pressure in the valve space 44 rises owing to fuel flowing in through the restrictor passage 90 and any further restrictor passage 96 which may be present, causing a movement of the intermediate valve member 78 away from the intermediate valve seat 82. This movement is further assisted by the dual plunger effect of the intermediate valve member 78 embodied in accordance with the present invention, wherein the adhesion counteracting this opening movement of the intermediate valve member 78 is minimized.

Raising the head 80 of the intermediate valve member 78 from the intermediate element 98 rapidly opens a large flow cross section from the annular space 120 into the control space 70, leading to rapid ending of the injection process since the injection valve member 56 is moved rapidly toward the injection valve seat 18 and comes to rest thereon.

In all the embodiments shown, the intermediate part 66 and the intermediate element 98 are each designed as an integral body. It is also possible for the intermediate part 66 and the intermediate element 98 to be formed by a single workpiece.

The invention claimed is:

1. A fuel injection valve for intermittent injection of fuel into a combustion chamber of an internal combustion engine, the injection valve having:

a housing which has a housing body and a nozzle body with an injection valve seat, a high-pressure space which is arranged in the housing and extends from a high-pressure fuel inlet to the injection valve seat, an injection valve member which is arranged movably in the housing and interacts with the injection valve seat, a compression spring which is supported on one side on the injection valve member and subjects the latter to a closing force directed toward the injection valve seat and is supported on another side in a fixed manner relative to the housing, a guiding part in which a control plunger of the injection valve member is guided with a sliding fit, an intermediate part, which, together with the guiding part and the control plunger, delimits a control space, a control device for controlling an axial movement of the injection valve member by varying the pressure in the control space, having an intermediate valve, a mushroom-shaped intermediate valve member which has a stem which is guided with a sliding fit in a guide passage of the intermediate part, and a head, a sealing surface which extends at a radial distance around the stem, resting in the closed position of the intermediate valve member against an annular intermediate valve seat formed on the intermediate part, thereby forming an annular sealing surface, an annular space, which is delimited by the intermediate part, the stem and the head and has a hollow-cylinder-shaped inner annular space extending around the stem, into which inner annular space a high-pressure fuel feed connected to the high-pressure fuel inlet directly opens, wherein the intermediate valve cuts off the high-pressure fuel feed and the annular space from the control space in the closed position of the intermediate valve member and otherwise opens the connection from the annular space and the high-pressure fuel feed to the control space, and the intermediate valve member continuously cuts off the control space from a valve space apart from a restrictor passage, and an electrically actuated actuator arrangement for connecting the valve space to and cutting the valve space off from a low-pressure fuel return, wherein the annular space has an annular gap space which adjoins the inner annular space and which is formed by a constant gap between the intermediate part and the head, in the closed position of the intermediate valve member, wherein the annular gap space is located radially outward of the inner annular space and is smaller than the inner annular space in a longitudinal direction.

2. The fuel injection valve as claimed in claim 1, wherein the annular gap space has a constant gap width in the closed position of the intermediate valve member.

3. The fuel injection valve as claimed in claim 1, wherein an opening of the high-pressure fuel feed is arranged fully in the region of the inner annular space.

4. The fuel injection valve as claimed in claim 1, wherein a width of the annular sealing surface is 0.1 mm to 1 mm measured in a radial direction.

5. The fuel injection valve as claimed in claim 1, wherein the annular gap space has a gap width of 0.04 mm to 0.4 mm, measured in a longitudinal direction, in the closed position of the intermediate valve member, to ensure that a surface of the head between the stem and the sealing surface is provided with an optimum supply of fuel during transient processes.

6. The fuel injection valve as claimed in claim 1, wherein the annular gap space has a width of at least 0.2 mm, measured in a radial direction.

7. The fuel injection valve as claimed in claim 1, wherein a projecting annular sealing bead in the form of a circular ring, a free end face of which forms the sealing surface, is formed on the head on the side thereof facing the intermediate part.

8. The fuel injection valve as claimed in claim 7, wherein the sealing bead has one of, a square or rectangular cross section.

9. The fuel injection valve as claimed in claim 7, wherein the sealing bead has a cross section corresponding to a right trapezoid, with right angles situated radially inside the trapezoid, and the head when viewed in cross section, forming a rectilinear extension of a radially outer oblique side of the trapezoid as far as a radial outer edge.

10. The fuel injection valve as claimed in claim 1, wherein an end face of the intermediate part which faces the control space and forms the intermediate valve seat is of flat design.

11. The fuel injection valve as claimed in claim 1, wherein a radially inner undercut is formed on a side of the head facing the intermediate part, and a radially outer undercut is formed on the intermediate part, and the inner undercut and the outer undercut delimit the annular sealing surface.

12. The fuel injection valve as claimed in claim 1, wherein an annular sealing bead, the free end face of which forms the intermediate valve seat, is formed on the intermediate part, on the side thereof facing the head.

13. The fuel injection valve as claimed in claim 1, wherein the valve space is continuously connected to the high-pressure space via a further restrictor passage.

14. The fuel injection valve as claimed in claim 1, wherein a plate-shaped intermediate element rests on the intermediate part, on a side facing away from the guiding part, and the intermediate element has, eccentrically with respect to the stem and the guide passage, an outlet passage which, together with the intermediate part and the intermediate valve member, delimits the valve space and which, on a side facing away from the intermediate part, is configured to be closed and opened by way of a tappet of the actuator arrangement.

15. The fuel injection valve as claimed in claim 1, wherein the guiding part is formed by a guiding sleeve on which the compression spring is supported, wherein the compression spring presses the guiding sleeve sealingly against the intermediate part of plate-shaped design.

16. The fuel injection valve as claimed in claim 2, wherein the gap width is at least five times smaller than the inner annular space, in each case measured in the longitudinal direction of the stem.

17. The fuel injection valve as claimed in claim 12, wherein the sealing bead is one of, square or rectangular in cross section.

18. The fuel injection valve as claimed in claim 1, wherein the stem is guided with a close sliding fit in the guide passage of the intermediate part.

19. A fuel injection valve for intermittent injection of fuel into a combustion chamber of an internal combustion engine, the injection valve having:

a housing which has a housing body and a nozzle body with an injection valve seat, a high-pressure space which is arranged in the housing and extends from a high-pressure fuel inlet to the injection valve seat, an injection valve member which is arranged movably in the housing and interacts with the injection valve seat, a compression spring which is supported on one side on the injection valve member and subjects the latter to a closing force directed toward the injection valve seat and is supported on another side in a fixed manner relative to the housing, a guiding part in which a control plunger of the injection valve member is guided with a sliding fit, an intermediate part, which, together with the guiding part and the control plunger, delimits a control space, a control device for controlling an axial movement of the injection valve member by varying the pressure in the control space, having an intermediate valve, a mushroom-shaped intermediate valve member which has a stem which is guided with a sliding fit in a guide passage of the intermediate part, and a head, a sealing surface which extends at a radial distance around the stem, resting in the closed position of the intermediate valve member against an annular intermediate valve seat formed on the intermediate part, thereby forming an annular sealing surface, an annular space, which is delimited by the intermediate part, the stem and the head and has a hollow-cylinder-shaped inner annular space extending around the stem into which inner annular space, a high-pressure fuel feed connected to the high-pressure fuel inlet opens, wherein the intermediate valve cuts off the high-pressure fuel feed and the annular space from the control space in the closed position of the intermediate valve member and otherwise opens the connection from the annular space and the high-pressure fuel feed to the control space, and the intermediate valve member continuously cuts off the control space from a valve space apart from a restrictor passage, and an electrically actuated actuator arrangement for connecting the valve space to and cutting the valve space off from a low-pressure fuel return, wherein the annular space has an annular gap space which adjoins the inner annular space and which is formed by a gap between the intermediate part and the head, in the closed position of the intermediate valve member, the annular gap space having a constant gap width in the closed position of the intermediate valve member, wherein the valve space is continuously connected to the high-pressure space via a further restrictor passage, wherein an opening of the high-pressure fuel feed is arranged fully in the region of the inner annular space, wherein a projecting annular sealing bead in the form of a circular ring, a free end face of which forms the sealing surface, is formed on the head on the side thereof facing the intermediate part, the sealing bead having one of, a square or rectangular cross section, wherein a plate-shaped intermediate element rests on the intermediate part, on a side facing away from the guiding part, and the intermediate element has, eccentrically with respect to the stem and the guide passage, an outlet passage which, together with the intermediate part and the intermediate valve member, delimits the valve space and which, on a side facing away from the intermediate part, is configured to be closed and opened by way of a tappet of the actuator arrangement, and wherein the guiding part is formed by a guiding sleeve on which the compression spring is supported, wherein the compression spring presses the guiding sleeve sealingly against the intermediate part of plate-shaped design.

20. The fuel injection valve as claimed in claim 19, wherein the stem is guided with a close sliding fit in the guide passage of the intermediate part.

* * * * *